US006088834A

United States Patent [19]

Seminara

[11] Patent Number: 6,088,834

[45] Date of Patent: Jul. 18, 2000

[54] BATTING GLOVE

[76] Inventor: Robert S. Seminara, 69 Bay Ridge Pkwy., Brooklyn, N.Y. 11209

[21] Appl. No.: 09/231,620

[22] Filed: Jan. 14, 1999

Related U.S. Application Data

[60] Provisional application No. 60/071,458, Jan. 14, 1998.

[51] Int. Cl.[7] ..... A41D 19/00

[52] U.S. Cl. ..... 2/161.1; 273/317.6

[58] Field of Search ..... 2/20, 21, 159, 2/161.1, 161.2, 161.3, 161.4, 161.5, 161.6, 163, 910; 273/317.6, 108.3; 294/25; 473/205; D29/117

[56] References Cited

U.S. PATENT DOCUMENTS

| | | | |
|---|---|---|---|
| 2,302,875 | 11/1942 | Lykins | 2/161.1 |
| 3,031,680 | 5/1962 | Compiano . | |
| 3,065,472 | 11/1962 | Linnell | 2/161.1 |
| 3,496,573 | 2/1970 | Kuchar . | |
| 3,863,271 | 2/1975 | Moroney . | |
| 4,000,903 | 1/1977 | Swanson | 473/205 |
| 4,329,741 | 5/1982 | Bach | 2/161.2 |
| 4,461,043 | 7/1984 | Lomedico | 2/21 |
| 4,700,405 | 10/1987 | Sternberg | 2/19 |
| 4,738,447 | 4/1988 | Brown | 473/450 |
| 4,843,651 | 7/1989 | Gramza | 2/161.1 |
| 5,218,719 | 6/1993 | Johnson | 2/19 |
| 5,471,682 | 12/1995 | Robins | 2/161 |
| 5,588,651 | 12/1996 | Frost | 473/206 |
| 5,634,214 | 6/1997 | St. Ville | 2/161.2 |
| 5,890,228 | 4/1999 | Wagner | 2/160 |

*Primary Examiner*—Diana L. Oleksa
*Assistant Examiner*—Katherine Moran
*Attorney, Agent, or Firm*—John D. Titus

[57] ABSTRACT

A batting glove incorporating a leather palm portion, a leather wrist portion including a hook and loop fastener, a leather finger portion including separate finger members having spaces therebetween and a leather thumb portion. Disposed between the palm and finger portions is a leather sheath housing an elongated raised rubber pad having inner and outer edges bounding a concave upper surface therebetween configured to cradle a bat handle. When the glove is worn by the batter, the outer edge is configured to be substantially aligned with the distal interphalangeal joints of the batter's hand and the inner edge is configured to be substantially aligned with metacarpal interphalangeal joints of the batter's hand.

20 Claims, 2 Drawing Sheets

BATTING GLOVE

This Application claims benefit of Provisional Appln No. 60/071,458 filed Jan. 14, 1998.

FIELD OF THE INVENTION

The present invention relates generally to sporting equipment and more particularly to an improved baseball or softball batting glove.

BACKGROUND OF INVENTION

In baseball and softball batting, the grip of the bat employed by the batter's driving hand, which is the hand placed atop the other when gripping the bat, is critical to the successful outcome of a particular at-bat. Baseball and softball batters are often instructed to grip the bat with the driving hand near the fingertips in order to better control the plane and timing of the bat swing thereby enhancing the ability to make consistent contact and place the batted ball where desired. This is generally a difficult instruction for batters to follow because batters tend to be most comfortable allowing the bat to rest deep in the cradle between the thumb and index finger, a grip commonly known as "throttling," giving a false feeling of improved bat control and greater hitting power.

Additionally, when the bat is throttled and the ball is struck by the end of the bat or by the portion of the bat near the hands, a strong shock is received by the batter's hand. This shock often bruises the bones of the thumb and index finger and the soft cradle of tissue lying between the thumb and index finger. Once a batter's hand sustains such a bruise, the hand becomes more sensitive to further shocks such that the batter may become less aggressive and, accordingly, less effective at the plate.

Accordingly, there exists a need in the art for an apparatus that encourages a properly oriented bat handle grip that promotes increased hitting production through sound technique and reduced injury risk. Additionally, it is desirable that the apparatus teach and/or condition the batter through repetitive use of the apparatus to properly grip the bat, thereby enabling a consistently employed proper grip with or without subsequent utilization of the apparatus.

SUMMARY OF THE INVENTION

According to the principles of the present invention, a batting glove that encourages a proper bat grip while reducing the injury risk to the batter's hands is disclosed. In the preferred embodiment of the invention, a batting glove is provided incorporating a leather palm portion, a leather wrist portion including a hook and loop fastener, a leather finger portion including separate finger members having spaces therebetween and a leather thumb portion. Disposed between the palm and finger portions is a leather sheath housing an elongated raised rubber pad having inner and outer edges bounding a concave upper surface therebetween configured to cradle a bat handle. The pad preferably has a hardness greater than that of cellular polystyrene, more commonly known as Styrofoam®. When the glove is worn by the batter, the outer edge is configured to be substantially aligned with the distal interphalangeal joints of the batter's hand and the inner edge is configured to be substantially aligned with the metacarpal interphalangeal joints of the batter's hand.

BRIEF DESCRIPTION OF THE DRAWING

The invention will be better understood from a reading of the following detailed description taken in conjunction with the drawing figures in which like reference designators are used to designate like elements, and in which.

DETAILED DESCRIPTION

Figure 1:
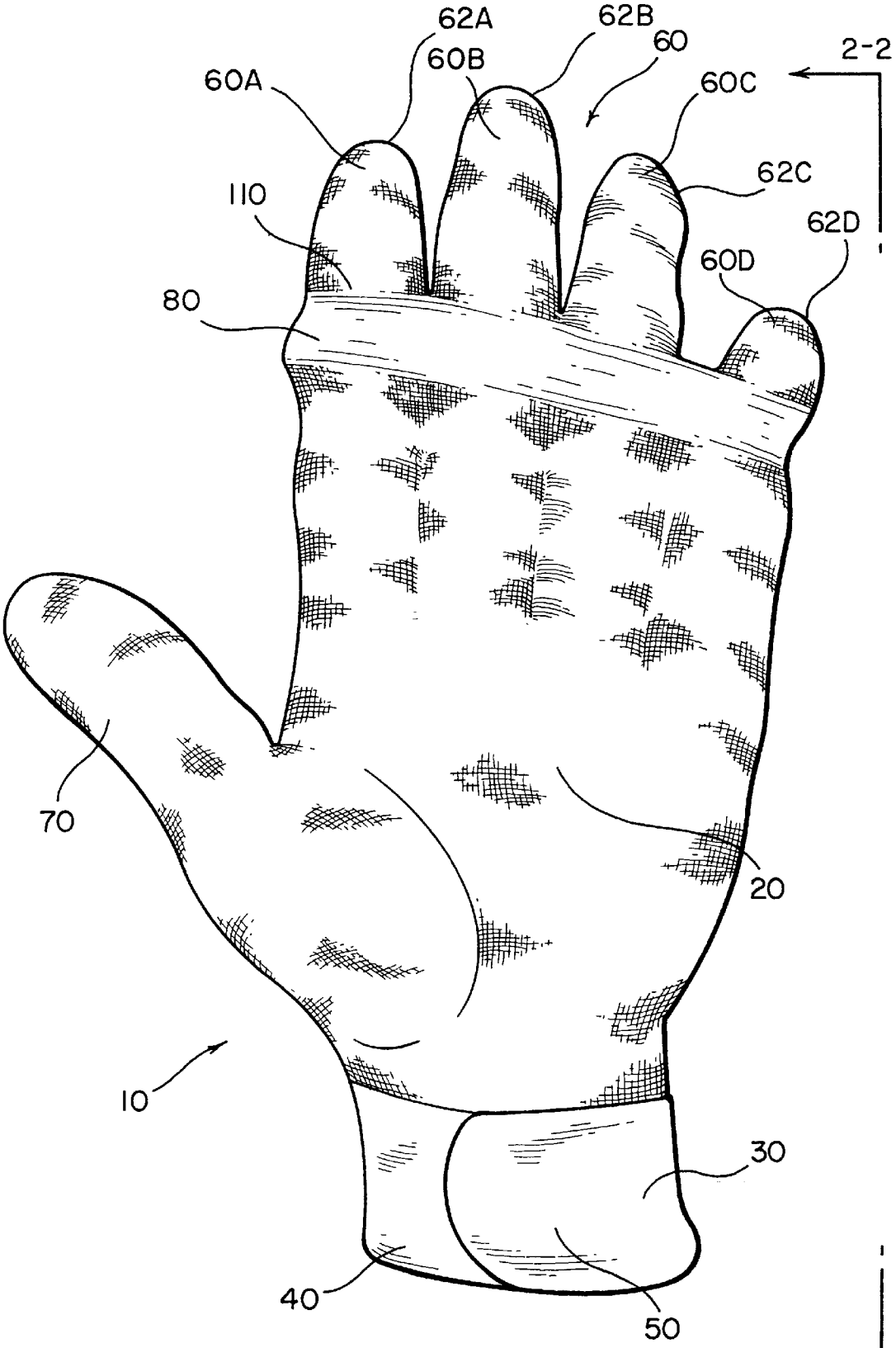
FIG. 1 is a plan view of the batting glove of the present invention.

The drawing figures are intended to illustrate the general manner of construction and are not to scale. In the description and in the claims the terms left, right, front and back and the like are used for descriptive purposes. However, it is understood that the embodiment of the invention described herein is capable of operation in other orientations than is shown and the terms so used are only for the purpose of describing relative positions and are interchangeable under appropriate circumstances.

Figure 2:
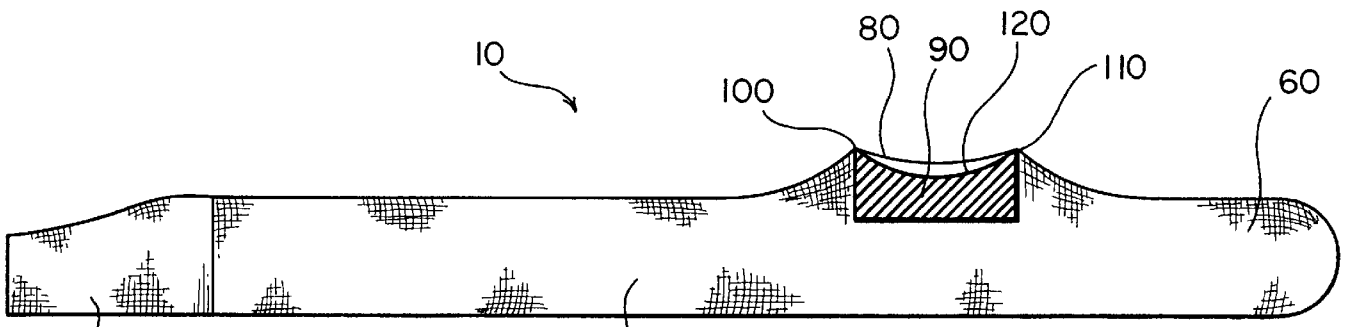
FIG. 2 is a transverse sectional view taken along line 2—2 in FIG. 1.

FIGS. 1 and 2 show the batting glove 10 of the present invention when not worn by a batter. The batting glove 10 incorporates a palm portion 20 serving to inhibit the formation of blisters on the wearer's palm. A wrist portion 30 having a main body 40 and a strap 50 is incorporated in order to secure the glove 10 to the wearer's hand. Preferably, main body 40 and strap 50 include cooperating hook and loop fasteners (not shown), although several different fastening elements known in the art may be substituted therefor. Finger portion 60 having separate finger members 60A, 60B, 60C and 60D is included. Finger members 60A, 60B, 60C and 60D are separated from each other extending from the finger tip portions 62A, 62B, 62C and 62D to a point approximately level with the outer edge 110 of pad 80, which is approximately even with the distal interphalangeal joints of the user's hand. The finger members 60A, 60B, 60C and 60D are joined together (or, alternatively, terminate at a unitary mitten) extending from the pad 80 inward toward the palm portion 20. Finger members 60A, 60B, 60C and 60D inhibit the formation of blisters on the wearer's fingers and position pad 80 relative to the user's hand as hereinafter described. Thumb portion 70 is included to inhibit the formation of blisters on the wearer's thumb region.

Figure 3:
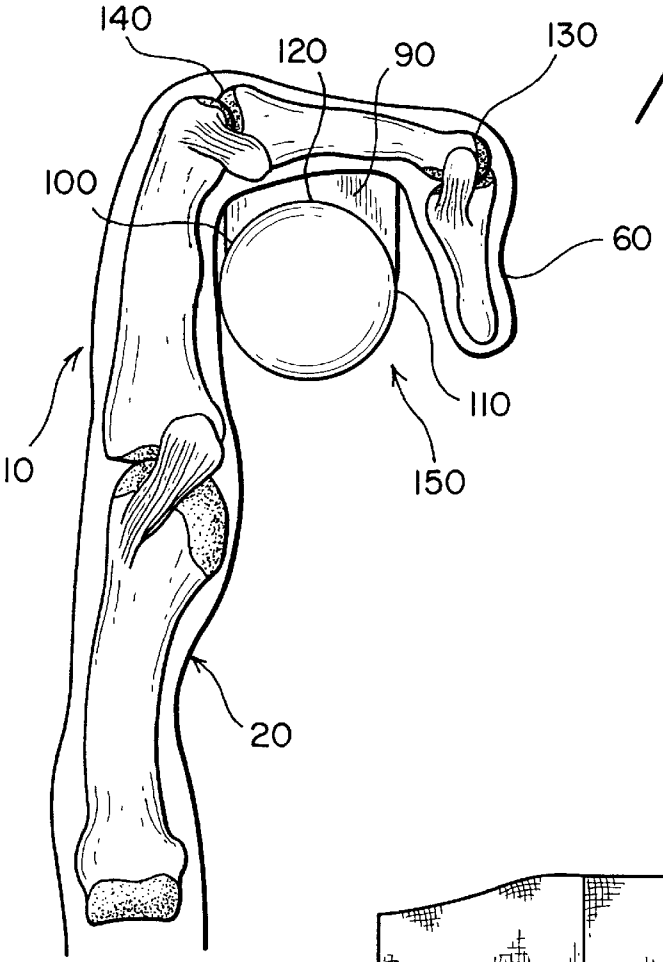
FIG. 3 is a perspective view showing the batting glove of the present invention on a wearer's hand and in gripping relation with a bat handle.

Disposed between palm portion 20 and finger portion 60 is a sheath 80 housing an elongated raised pad 90. Pad 90 comprises an inner edge 100, an outer edge 110 and a concave upper surface 120 disposed therebetween. Surface 120 is preferably of a radius of curvature substantially equal to the radius of a regulation bat handle (i.e., between 1.875 and 4.375 inches) in order to cradle a bat handle 150. As shown in FIG. 3, sheath 80 and pad 90 are configured such that, when the glove 10 is worn by the batter, outer edge 110 is substantially aligned with the distal interphalangeal joints 130 of the batter's hand and inner edge 100 is substantially aligned with the metacarpal interphalangeal joints 140 of the batter's hand. By cradling the bat handle 150, pad upper surface 120 biases the bat handle 150 toward the batter's fingertips thereby promoting improved bat control and reduced injury risk to the thumb and immediately surrounding regions. Preferably, pad 90 is composed of rubber having a hardness greater than that of cellular polystyrene, more commonly known as Styrofoam®.

Although the invention has been described in terms of the illustrative embodiment, it will be appreciated by those skilled in the art that various changes and modifications may be made to the illustrative embodiment without departing from the spirit or scope of the invention. It is intended that the scope of the invention not be limited in any way to the illustrative embodiment shown and described but that the invention be limited only by the claims appended hereto.

What is claimed is:

1. A batting glove to be worn on a batter's hand, the hand having distal interphalangeal joints and metacarpal interphalangeal joints, said glove comprising:

a palm portion; and an elongated raised pad adjacent one end of said palm portion having an inner edge and an outer edge and a concave upper surface therebetween, said outer edge configured to be substantially aligned with the distal interphalangeal joints when said glove is worn, said inner edge configured to be substantially aligned with the metacarpal interphalangeal joints when said glove is worn.

2. A batting glove in accordance with claim 1 comprising a wrist portion adjacent an end of said palm portion opposite said raised pad.

3. A batting glove in accordance with claim 2 wherein said wrist portion comprises a hook and loop fastener.

4. A batting glove in accordance with claim 1 comprising a finger portion adjacent an end of said raised pad opposite said palm portion.

5. A batting glove in accordance with claim 4 wherein said finger portion comprises separate finger members having spaces therebetween.

6. A batting glove in accordance with claim 5 wherein said finger portion comprises finger tip portions, said finger members being separated from each other extending from said finger tip portions to said outer edge.

7. A batting glove in accordance with claim 1 comprising a thumb portion on one side of said palm portion.

8. A batting glove in accordance with claim 1 wherein said pad comprises rubber having a hardness greater than that of cellular polystyrene.

9. A batting glove in accordance with claim 1 wherein said surface has a radius of curvature substantially equal to the radius of a regulation bat handle.

10. A batting glove in accordance with claim 1 comprising a sheath enveloping said pad.

11. A batting glove to be worn on a batter's driving hand, the hand having distal interphalangeal joints and metacarpal interphalangeal joints, said glove comprising:

a leather palm portion;

an elongated raised rubber pad adjacent one end of said palm portion having an inner edge and an outer edge and a concave upper surface therebetween, said outer edge configured to be substantially aligned with the distal interphalangeal joints when said glove is worn, said inner edge configured to be substantially aligned with the metacarpal interphalangeal joints when said glove is worn, said pad having a hardness greater than that of cellular polystyrene, said surface having a radius of curvature substantially equal to the radius of a regulation bat handle;

a leather sheath enveloping said pad;

a leather wrist portion adjacent an end of said palm portion opposite said raised pad, said wrist portion including a hook and loop fastener;

a leather finger portion adjacent an end of said raised pad opposite said palm portion, said finger portion including separate finger members having spaces therebetween, said finger portion including finger tip portions, said finger members being separated from each other extending from said finger tip portions to said outer edge; and a leather thumb portion on one side of said palm portion.

12. A method of gripping a baseball bat or the like with a driving hand whereby the bat handle is forced away from the thumb base of the hand and into the region adjacent the metacarpal interphalangeal joints of the hand, the method comprising the steps of:

forming a batting glove comprising a palm portion;

forming an elongated raised pad adjacent one end of said palm portion having an inner edge and an outer edge and a concave upper surface therebetween;

inserting the driving hand into said batting glove such that said outer edge is substantially aligned with the distal interphalangeal joints and said inner edge is substantially aligned with the metacarpal interphalangeal joints; and gripping the at handle such that the handle is engaged by said upper surface.

13. A method in accordance with claim 12 comprising the step of forming a wrist portion adjacent an end of said palm portion opposite said raised pad.

14. A method in accordance with claim 13 wherein said wrist portion comprises a hook and loop fastener.

15. A method in accordance with claim 12 comprising the step of forming a finger portion adjacent an end of said raised pad opposite said palm portion.

16. A method in accordance with claim 15 wherein said finger portion comprises separate finger members having spaces therebetween.

17. A method in accordance with claim 12 comprising the step of forming a thumb portion on one side of said palm portion.

18. A method in accordance with claim 12 wherein said pad comprises rubber having a hardness greater than that of cellular polystyrene.

19. A method in accordance with claim 12 comprising the step of forming a sheath enveloping said pad.

20. A method of gripping a baseball bat or the like with a driving hand whereby the bat handle is forced away from the thumb base of the hand and into the region adjacent the metacarpal interphalangeal joints of the hand, the method comprising the steps of:

forming a batting glove comprising a leather palm portion;

forming an elongated raised rubber pad adjacent one end of and attached to said palm portion having an inner edge and an outer edge and a concave upper surface therebetween, said pad having a hardness greater than that of cellular polystyrene;

forming a leather sheath enveloping said pad;

forming a leather wrist portion adjacent an end of said palm portion opposite said raised pad, said wrist portion including a hook and loop fastener;

forming a leather finger portion adjacent an end of said raised pad opposite said palm portion, said finger portion including separate finger members having spaces therebetween;

forming a leather thumb portion on one side of said palm portion;

inserting the driving hand into said batting glove such that said outer edge is substantially aligned with the distal interphalangeal joints and said inner edge is substantially aligned with the metacarpal interphalangeal joints; and gripping the bat handle such that the handle is engaged by said upper surface.

* * * * *